United States Patent [19]

Bothner

[11] Patent Number: 4,763,387

[45] Date of Patent: Aug. 16, 1988

[54] STRIP FEEDER BETWEEN ENTRANCE AND CALENDERING ROLLS OF A TEXTILE MACHINE

[75] Inventor: Jakob Bothner, Göppingen-Jebenhausen, Fed. Rep. of Germany

[73] Assignee: Zinser Textilmaschinen GmbH, Ebersbach/Fils, Fed. Rep. of Germany

[21] Appl. No.: 34,756

[22] Filed: Apr. 6, 1987

[30] Foreign Application Priority Data

Apr. 10, 1986 [DE] Fed. Rep. of Germany ..... 3612133

[51] Int. Cl.[4] ..... D01H 5/72; D01H 13/04; D01H 5/28

[52] U.S. Cl. ..... 19/288; 19/157; 19/258

[58] Field of Search ..... 19/288, 289, 290, 291, 19/292, 157, 258

[56] References Cited

U.S. PATENT DOCUMENTS 4,372,010 2/1983 Gauvain ..... 19/288 X
4,485,528 12/1984 Anahara et al. ..... 19/288 X

FOREIGN PATENT DOCUMENTS 3436526 4/1986 Fed. Rep. of Germany ..... 19/288
0124852 3/1959 U.S.S.R. ..... 19/288

*Primary Examiner*—Louis K. Rimrodt
*Attorney, Agent, or Firm*—Herbert Dubno

[57] ABSTRACT

The fiber strip feed device provided with a fiber strip feed duct between the entrance rolls and the calendering rolls in a spinning machine, particularly in a set of drafting rolls of the spinning machine, has a tangential housing air duct opening into the fiber strip feed duct which is cylindrical. A fiber strip funnel is located downstream of the feed duct toward whose constricted inner space a high pressure pipe is directed whose working direction crosses the axis of the fiber strip funnel for fiber strip feed.

16 Claims, 3 Drawing Sheets

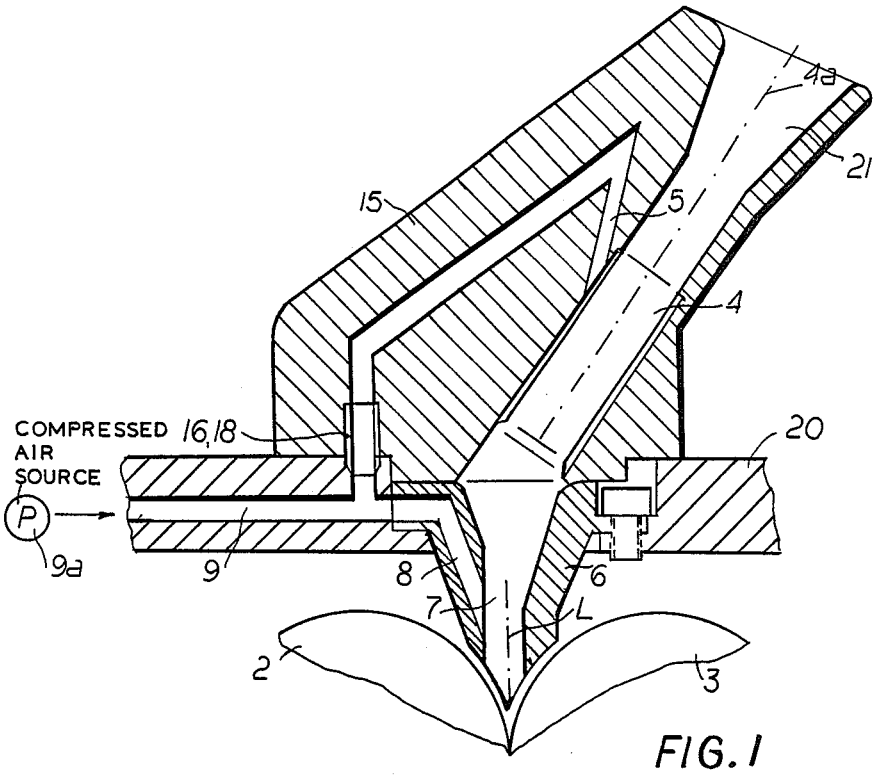
FIG. 1
FIG. 3
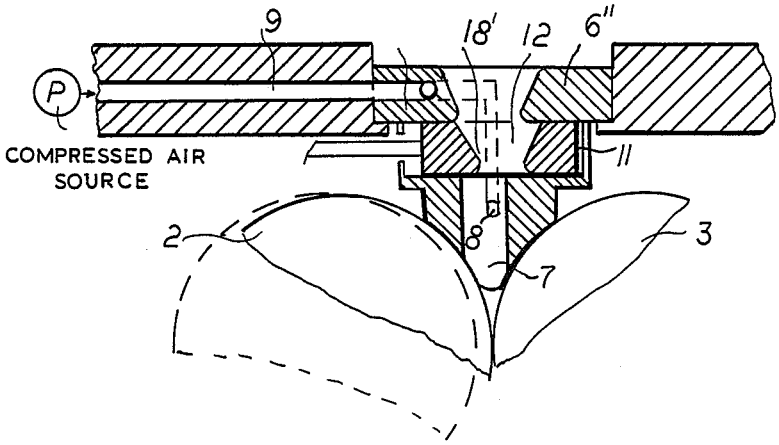

STRIP FEEDER BETWEEN ENTRANCE AND CALENDERING ROLLS OF A TEXTILE MACHINE

FIELD OF THE INVENTION

My present invention relates to a fiber strip feeder for a textile machine and, more particularly, to the roving or sliver preparation section of a spinning-preparation machine and to the fiber strip feeder for a drafting frame which is located between the entrance or intake rolls and a pair of calendering rolls.

BACKGROUND OF THE INVENTION

A fiber strip feeder provided with a feed duct between the entrance rolls and the calendering rolls of a drafting unit of a spinning preparation machine is known having a tangential housing air duct opening into a cylindrical fiber strip feed duct. The "fiber strip" can be a roving or sliver.

Such a device has been described in German Open Application DE-OS No. 30 34 812.

The fiber strip feed duct between the entrance rolls and the calendering rolls of a drafting unit is used as an injector for feeding the roving or sliver between the calendering rolls.

The housing air duct opening into it is inclined tangentially to the fiber strip feed duct so that a fiber strip not only is given a feed motion but also a rotational motion.

The use of a cylindrical fiber strip feed duct is presumed for proper functioning of this apparatus.

It is also known to associate the calendering rolls with a narrow fiber strip funnel to keep the fiber strips strongly compressed and thus to attain a high can filling rate. This known fiber strip funnel however tends to restrict the fiber strip feed and may cause clogging.

OBJECTS OF THE INVENTION

It is an object of my invention to provide an improved fiber strip feeder between the entrance rolls and the calendering rolls of a spinning-preparation machine which obviates the drawbacks of earlier feeders.

It is also an object of my invention to provide an improved fiber strip feeder between the entrance rolls and calendering rolls which is such that the feed and rotational motion of the fiber strips occurs undisturbed without clogging despite the use of a fiber strip funnel.

SUMMARY OF THE INVENTION

These objects and others which will become more readily apparent hereinafter are attained in accordance with my invention in a fiber strip feeder provided with a fiber strip feed duct between the entrance rolls and the calendering rolls in a spinning-preparation machine, particularly in a drafting unit, having a tangential housing air duct opening into a fiber strip feed duct.

According to my invention a fiber strip funnel is located downstream of the fiber strip feed duct toward whose constricted inner space a high pressure pipe (connected to a compressed-air source) is directed whose working direction crosses the axis of the fiber strip funnel for fiber strip feed. This has the advantage that the fiber strip funnel forms an injector and contributes to the feeding of the fiber strips in the desired direction.

In a particularly advantageous embodiment of my invention the high pressure pipe opens directly into the fiber strip funnel and is inclined to the direction of the fiber strip feed.

In a further development of my invention for the case in which the axes of the cylindrical fiber strip feed duct and the downstream fiber strip funnel are inclined to each other the outlet opening of the high pressure pipe associated with the fiber strip funnel is arranged in the wall of a housing containing the cylindrical fiber strip feed duct on an imaginary extension of the axis of the fiber strip funnel.

The high pressure air pipe is advantageously operable with the calendering rolls separated when the calendering rolls are separable from each other for feeding fiber strips.

In a particularly advantageous embodiment of my invention the high pressure pipe opens directly into the fiber strip funnel and is inclined to the direction of the fiber strip feed.

For imparting rotational motion to the fiber strip, the outlet opening of a housing air duct of the housing can open tangentially into the cylindrical portion of the fiber strip feed duct.

The fiber strip is so strongly inclined in the fiber strip funnel that it can not be rotated by having the outlet opening of the air duct open tangentially into the fiber strip funnel.

On the other hand, the hole-like passage though the fiber strip funnel is kept as narrow as possible. When the injection action of the fiber strip funnel is impeded when no space is present for the air to pass through the compressed fiber strips, according to a further feature of my invention, the cross section of the funnel is changeable by at least one masking element. This masking element can be a slider slidable transverse to the feed direction above the constricted inner space of the funnel. The slider can also have a rounded conical hole-like passage cooperating with the constricted inner space as a further feature of my invention.

The slider can also have a conically running inwardly curved rounded front surface for varying the cross section of the fiber strip funnel.

Furthermore the axis of the hole-like passage of the slider can be located in a plane substantially perpendicular to the axis of the downstream compressing rolls or the calendering rolls.

The housing air duct and the high pressure pipe can be connected with a common principal air duct.

To permit an easy accessibility for threading the fiber roving or sliver and for cleaning of the cylindrical fiber strip duct, the housing containing the cylindrical fiber strip feed duct mounted on a fixed support is justified or spaced by a connecting element having connecting surfaces which fit snugly against surfaces of both parts and is held in place by or mounted with a retaining element. The retaining element adjacent the connecting element can be a permanent magnet.

Furthermore, a connector pipe of the high pressure pipe extending from the fixed support into the housing containing the cylindrical fiber strip feed duct and providing a connection to the cylindrical fiber strip feed duct can be the connecting element mentioned in the previous paragraph. The magnetic mounting of the housing containing the cylindrical fiber strip feed duct has the advantage that in case of clogging of the cylindrical fiber strip duct or its funnel-like inlet it can be pushed off without causing damage because of this clogging by further feeding of roving or sliver.

BRIEF DESCRIPTION OF THE DRAWING

The above and other objects, features and advantages of my invention will become more readily apparent from the following description, reference being made to the accompanying highly diagrammatic drawing in which:

FIG. 1 is a cross sectional view through one embodiment of a fiber strip feeder between the entrance rolls and the calendering rolls according to my invention;

FIG. 3 is a cross sectional view through a portion of a third embodiment of a fiber strip feeder between output and calendering rolls according to my invention without a housing and with an upper section of the feed duct absent.

SPECIFIC DESCRIPTION

Figure 2:
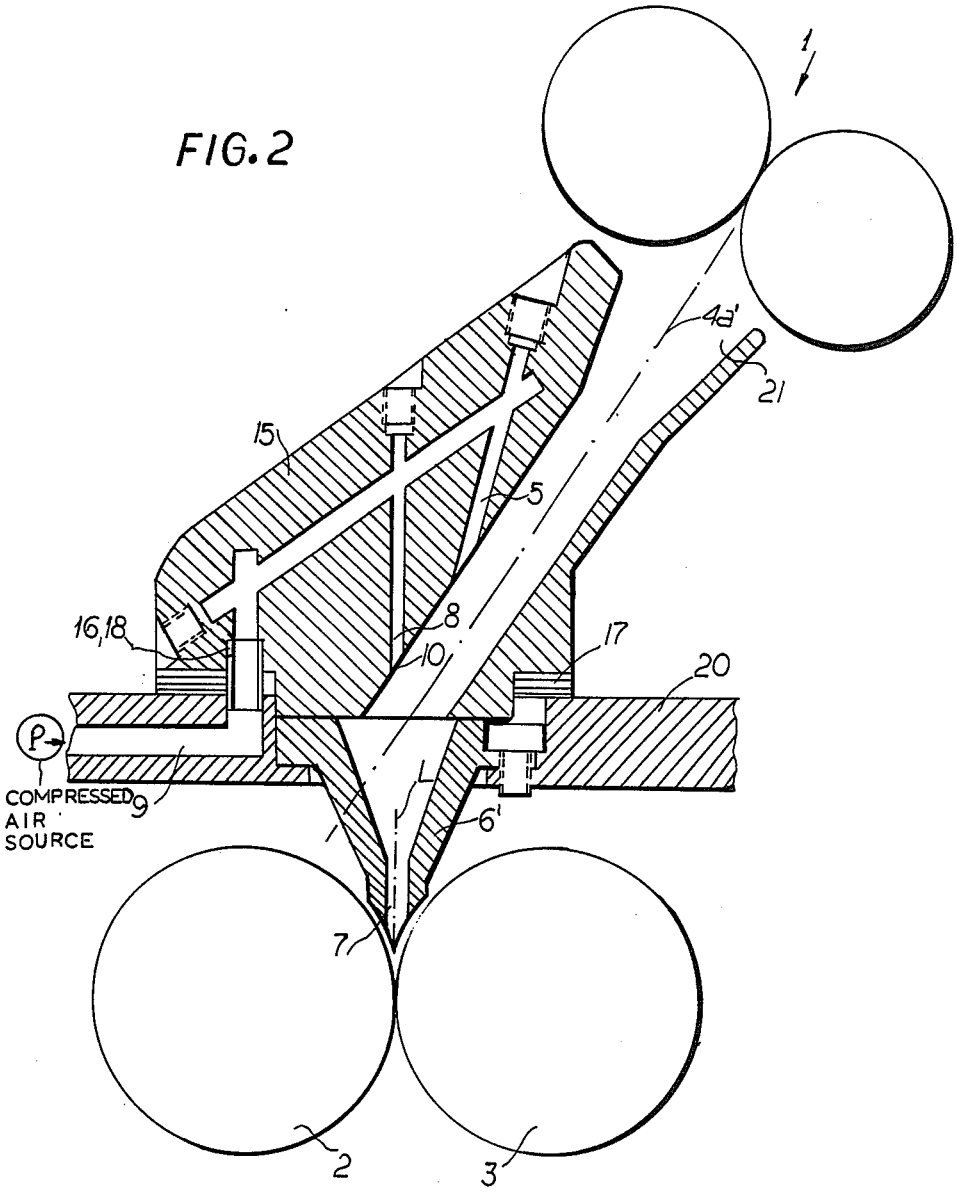
FIG. 2 is a cross sectional view through another embodiment of a fiber strip feeder according to my invention.

As shown in FIG. 1, a housing 15 is mounted on a fixed support 20 above the calendering rolls 2 and 3 in a device in a spinning-preparation machine which prepares the fiber for spinning, particularly in a set of drafting rolls. A principal air duct 9 which is connected to a housing air duct 5 in the housing 15 is located in the support 20. This housing air duct 5 opens tangentially into a cylindrical fiber strip feed duct 4. The air duct 5 is connected to the compressor 9*a*.

A fiber strip funnel 6 which has a constricted inner space 7 adjacent the calendering rolls 2 and 3 is located under the fiber strip feed duct 4. A high pressure air passage 8 which is connected with the principal air duct 9 opens into the fiber strip funnel 6 and is inclined toward the fiber strip feed direction.

The action of this high pressure air passage 8 is directed through the longitudinal axis L of the fiber strip funnel 6 for strip feed. Thus this fiber strip funnel 6 with the aid of the high pressure air passage 8 acts as an injector.

To guarantee a proper mounting of the housing 15 on the fixed support 20 a connecting element 16 is provided which can be a connector passage 18. The fiber strip funnel 6 for its part is mounted with a screw coupling not shown in detail in the fixed support 20.

The axis 4*a*′ of the cylindrical fiber strip feed duct 4′ and of the following fiber strip funnel 6′ are appropriately inclined toward each other in the embodiment according to FIG. 2. A housing air duct 5 which opens tangentially into the fiber strip guide duct 4′ is provided in the housing 15 as in the embodiment above.

The high pressure air passage 8′ with its outlet opening 10 is provided in the wall of the housing 15 positioned on an imaginary extension of the longitudinal central axis L of the fiber strip funnel 6. The housing air duct 5 and the high pressure air passage 8′ are fed with air by the common principal air duct 9.

The entire unit comprising the housing 15 with the fiber strip feed duct 4′ and fiber strip funnel 6′ downstream of the feed duct 4′ is located between the entrance rolls 1 and the calendering rolls 2 and 3 in a spinning-preparation machine or in a device which prepares the fiber for spinning and which is part of a spinning-preparation machine.

The housing 15 is mounted on the fixed support 20 on which the fiber strip funnel 6′ is mounted. For justification or spacing, a connecting element 16 which is a connector passage 18 is installed.

A permanent magnet can be used as the retaining element 17 for mounting the housing 15 on the fixed support 20. This permanent magnet can be mounted on one of each of these parts while the other part is ferromagnetic. Another possibility is that the permanent magnet is inserted loose between both ferromagnetic parts. Also both parts can be provided with permanent magnets.

The magnetic mounting of the housing 15 containing the fiber strip feed duct 4′ has the advantage that this housing 15 can be pushed off by additionally fed in roving or sliver in case the cylindrical fiber strip feed duct 4′ or its funnel shaped entrance 21 is clogged. A simple but effective mounting of the housing 15 on the support 20 is present then because of the permanent magnet used as the retaining element 17.

The spacing between the calendering rolls 2 and 3 must necessarily be increased on operation of an air blowing device connected with the housing air duct 5 for feeding the fiber strips.

As is apparent from FIG. 3 the calendering roll 2 can be pushed away from the calendering roll 3. To facilitate this threading process the fiber strip funnel 6″ can have a masking element 11 as in the embodiment of FIG. 3.

This masking element 11 is a slider 13 and has a conical hole like passage 12 cooperating with the constricted inner space 7. The opening 12 and the constricted inner space 7 are coincident in the threading process so that the threading process experiences no hindrances.

In normal operation the slider 13 opposite the inner space 7 is found in the position illustrated in FIG. 3, i.e. the axis of the hole-like passage 12 is cut off or clipped and the edge 18′ of the passage 12 forms a round cross section opening with the opposing edges of the constricted inner space 7. A high pressure air passage 8 is provided as above in the fiber strip funnel 6″ and it acts in the direction of the axis of the fiber strip funnel 6 to feed strips.

Figure 4:
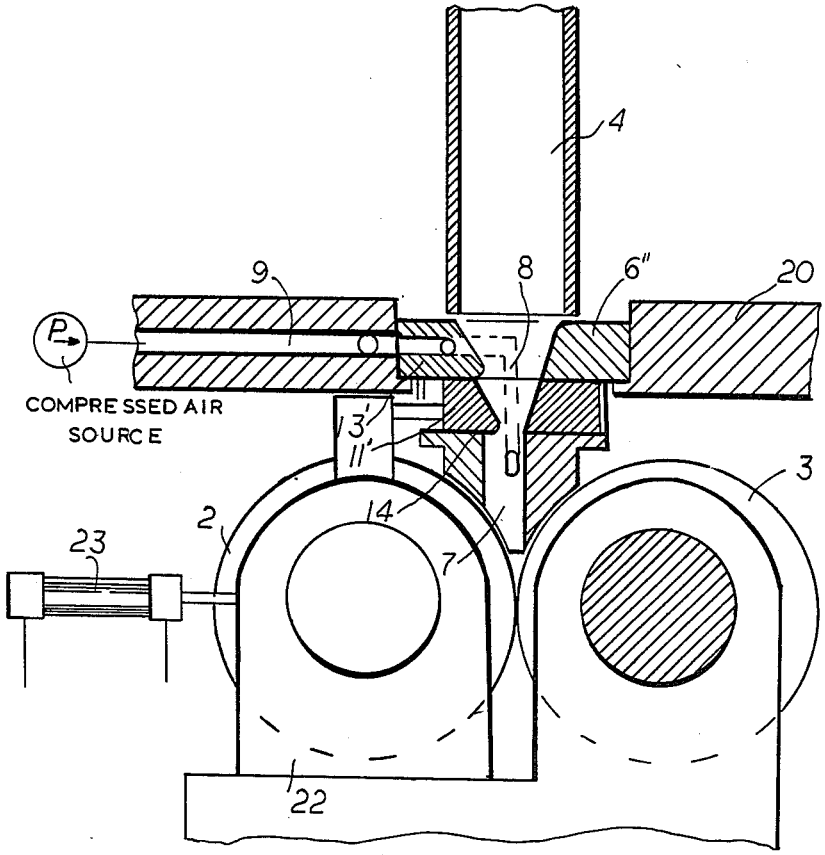
FIG. 4 is a cross sectional view through a fourth embodiment of a fiber strip feeder between the entrance rolls and the calendering rolls according to my invention.

A slider 13′ is provided as a masking element 11′ in the fiber strip funnel 6″ in the embodiment of FIG. 4. The funnel 6″ has a conically running inwardly curved front surface 14 for changing the cross section from that of the inner space 7. This slider 13′ is mounted on a supporting body 22 by intermediate elements. This supporting body 22 supports the calendering roll 2 and is acted on by a piston-cylinder unit 23 to move the calendering rolls 2 and thus simultaneously the slider 13′ to the left so that threading process is not impeded.

The passage through the fiber strip funnel 6″ is increased with the help of the slider 13 and/or 13′ in the threading process in the embodiments of FIGS. 3 and 4. Thus the action of both air ducts 5 and 8 and/or 8′ separates the calendering rolls 2 and 3 from each other and simultaneously enlarges the cross section of the fiber strip funnel.

I claim:

1. In a fiber strip feeder provided with a fiber strip feed duct between the entrance rolls and the calendering rolls in a spinning-preparation machine, particularly in a set of drafting rolls of said spinning-preparation machine, having a tangential housing air duct opening into said fiber strip feed duct, the improvement wherein a fiber strip funnel is located downstream of said fiber strip feed duct toward whose constricted inner space a high pressure passage is directed whose working direction crosses the axis of said fiber strip funnel for fiber strip feed.

2. The improvement defined in claim 1 wherein the calendering rolls are separable from each other, further comprising means enabling operation of said high pressure air passage with said calendering rolls separated.

3. The improvement according to claim 1 wherein said high pressure passage opens into said fiber strip funnel and is inclined to the direction of said fiber strip feed.

4. The improvement according to claim 1 wherein the axis of said fiber strip feed duct and said axis of said fiber strip funnel are inclined to each other and the outlet opening of said high pressure passage is located on the wall of a housing containing said fiber strip duct on said axis of said fiber strip funnel.

5. The improvement according to claim 4 wherein said housing containing said fiber strip feed duct is justified above said fiber strip funnel by at least one connecting element and is mounted with at least one retaining element.

6. The improvement according to claim 12 wherein said connecting element is a connector passage located near a branch of a principal air duct connected to said housing air duct and said high pressure passage.

7. The improvement according to claim 5 wherein said retaining element is a permanent magnet.

8. The improvement according to claim 1 wherein the cross section of said fiber strip funnel is made variable by at least one masking element.

9. The improvement according to claim 8 wherein said masking element is a slider slidable transverse to the direction of said fiber strip feed located in said fiber strip funnel above said constricted inner space.

10. The improvement according to claim 9 wherein said slider is provided having a conical hole-like passage cooperating with said constricted inner space.

11. The improvement according to claim 10 wherein said hole like passage is rounded.

12. The improvement according to claim 9 wherein said slider has a conically running inwardly curved front surface for varying said cross section of said fiber strip funnel.

13. The improvement according to claim 12 wherein said conically running inwardly curved front surface is rounded.

14. The improvement according to claim 1 wherein said housing air duct and said high pressure passage are connected with a common principal air duct.

15. A fiber strip feeder between the entrance rolls and the calendering rolls in a spinning-preparation machine, particularly in a set of drafting rolls of said spinning-preparation machine, comprising:

a housing being provided with a fiber strip feed duct;

a tangential housing air duct in said housing opening into said fiber strip feed duct;

a fiber strip funnel located downstream of said fiber strip feed duct;

a high pressure passage directed toward the constricted inner space of said fiber strip funnel which opens into said fiber strip funnel for fiber strip feed and is inclined to the direction of fiber strip feed;

at least one mask element for making the cross section of said fiber strip funnel variable which is a slider having a conical hole like passage cooperating with said constricted inner space slidable transverse to the direction of said fiber strip feed located in said fiber strip funnel above said constricted inner space, said slider having a conically running rounded inwardly curved front surface for varying said cross section of said fiber strip funnel;

a common principal air duct connected to said housing air duct and said high pressure passage;

at least one connecting element which is a connector passage located near a branch of said principal air duct above said fiber strip funnel by which said housing containing said fiber strip duct is justified or mounted; and at least one retaining element adjacent said connecting element for mounting which is a permanent magnet.

16. A fiber strip feeder between the entrance rolls and the calendering rolls in a spinning-preparation machine, particularly in a set of drafting rolls of said spinning-preparation machine, comprising:

a housing being provided with a fiber strip feed duct;

a tangential housing air duct in said housing opening into said fiber strip feed duct;

a fiber strip funnel located downstream of said fiber strip feed duct;

a high pressure passage directed toward a constricted inner space of said fiber strip funnel which opens into said fiber strip funnel for fiber strip feed and is inclined to the direction of fiber strip feed.

* * * * *